United States Patent [19]

Bolton

[11] 4,292,815

[45] Oct. 6, 1981

[54] DOOR ASSEMBLY FOR A SELF-CONTAINED AIR CONDITIONING UNIT

[75] Inventor: Theodore S. Bolton, Liverpool, N.Y.

[73] Assignee: Carrier Corporation, Syracuse, N.Y.

[21] Appl. No.: 60,327

[22] Filed: Jul. 25, 1979

[51] Int. Cl.[3] ..... F25D 23/12

[52] U.S. Cl. ..... 62/262; 62/265; 98/94; 16/166

[58] Field of Search ..... 62/262, 265; 98/94, 98/116, 29, 32; 49/381, 90, 91; 16/141, 142, 166, DIG. 13

[56] References Cited

U.S. PATENT DOCUMENTS

| | | | |
|---|---|---|---|
| 2,798,263 | 7/1957 | Hardy | 49/90 |
| 3,431,748 | 3/1969 | Bolton | 62/262 |
| 3,733,843 | 5/1973 | MacLeod | 62/262 |
| 3,789,619 | 2/1974 | Kincaid et al. | 62/262 |
| 4,011,801 | 3/1977 | Bruns | 98/94 |

FOREIGN PATENT DOCUMENTS

| | | | |
|---|---|---|---|
| 63344 | 11/1891 | Fed. Rep. of Germany | 16/166 |

*Primary Examiner*—Albert J. Makay
*Assistant Examiner*—Henry Bennett
*Attorney, Agent, or Firm*—J. Raymond Curtin; Robert P. Hayter

[57] ABSTRACT

Apparatus for use in a self-contained air conditioning unit for controlling the operation of a door. The combination of pins extending from the door and slots defined by the end surface of a casing provide lost motion rotation operation of the door. Additionally, a friction wedge is provided which both secures the door in any of a range of positions and further serves to allow the door to open a predetermined amount when the unit is energized and air flow is discharged through the opening covered by the door.

7 Claims, 7 Drawing Figures

DOOR ASSEMBLY FOR A SELF-CONTAINED AIR CONDITIONING UNIT

BACKGROUND OF THE INVENTION

1. Field of the Invention

The present invention relates to a self-contained air conditioning unit. More particularly, the present invention concerns a discharge door assembly for use with a room air conditioning unit.

2. Description of the Prior Art

A room air conditioning unit typically adapted to be mounted in a window or through a wall to provide conditioned air to one or more rooms utilizes a conventional vapor compression refrigeration circuit. A compressor is utilized to increase the temperature and pressure of a refrigerant which is then condensed rejecting heat to ambient air. The condensed refrigerant then undergoes a pressure drop through an expansion device and is connected to an evaporator where it changes state from a liquid to a gas absorbing heat from the air to be conditioned. This gas is recycled to the compressor to complete the cycle. An evaporator fan is utilized to draw air to be conditioned through the evaporator heat exchanger such that heat may be rejected from the air to the refrigerant flowing through the heat exchanger. This conditioned air is then discharged into the enclosure. Apparatus is often provided to direct the flow of this discharged air into the desired location within the enclosure. Residential air conditioning units, especially those which extend through the wall of a residence or are mounted in a window of a residence, include a discharge port for discharging conditioned air from the unit into the space to be conditioned, and a door for controlling the opening of the port. When such a unit is not in use, the discharge door is normally closed for the purposes of appearance, to prevent persons from accidentally striking the door, and to prevent the insertion of articles into the discharge port. It is very important that the discharge door be open whenever the unit is operating, because failure to open the door can result in the build-up of ice on the evaporator coils of the unit which could seriously damage the unit. Moreover, such failure to open the door can cause the thermostatic controls of the unit to shut the unit down before the space has been conditioned.

Prior art devices have attempted to provide frictional devices for securing the discharge door in various positions such as by providing frictional engagement between a strap attached to a door and a plate. Additionally, prior art devices have attempted to provide coaxial end fittings on the door such that it can be rotated partially by the force of the discharged air and further opened by an application of manual force thereto. This was accomplished utilizing hinge pins having cylindrical body portions which frictionally engage the door and noncylindrical end portions which are mounted for limited rotation in a housing. The discharge door would rotate with the hinge pins a limited extent before the housing was contacted and thereafter the hinge pins would rotate around the housing. Another prior art device has combined a pin extending from the door into a slot and a pin extending from the casing into a groove in the door.

The present invention concerns a casing defining a discharge door opening and having multiple slots for the entry of air to be conditioned. A door for covering said opening is mounted such that two pins extending from each end of the door are inserted into the slots enabling a lost motion type rotation of the door to be achieved. The combination of pins and slots allows the door to be rotated about a constantly changing axis of rotation and furthermore provides for the bottom of the door to form a seal with the casing regardless of the door position.

Additionally, a friction wedge is provided having a friction surface which may secure the door in a position throughout a range of positions. The friction wedge additionally has an inclined surface which upon the door being partially opened contacts an edge of one of the slots. When the unit is operated, the conditioned air being discharged to the enclosure has sufficient pressure to force the door partially open until the inclined surface engages the slot. To further open the door a manual force is required since the frictional force exerted by the friction surface must be overcome.

SUMMARY OF THE INVENTION

It is an object of the invention to provide an improved door assembly for a self-contained air conditioning unit wherein said door may be rotated with a lost motion via a pin and slot mechanism such that the axis of rotation of the door is not stationary. Additionally, friction means are provided to limit the opening of the door caused by the force of the air being discharged from the unit and subsequently to secure the door in a position to which it is manually placed.

Another object of the present invention is to provide a safe, reliable, efficient, economical door assembly for a room air conditioning type unit.

These and other objects are achieved according to the preferred embodiment of the present invention by the provision of a casing defining a discharge door opening, said casing having end surfaces with two slots formed in each. A door is mounted to cover the opening. The door has pins located on each end to coact with the slots such that the door may be rotated with the pins moving in the slots. By the utilization of this lost rotation mechanism the bottom door contact surface is maintained in relative position with the bottom casing sealing surface such that a relatively tight seal is maintained at the bottom of the door at all times. Additionally, a friction wedge extends from the door into engagement with the side surface of the casing such that a friction surface is provided to secure the door in a preset position. An inclined surface is further provided to allow the door to be forced partially open upon air being discharged from the unit.

DESCRIPTION OF THE PREFERRED EMBODIMENT

The hereinafter described door assembly will be detailed in reference to a room air unit. It is to be understood that this door mechanism can be used for similar air conditioning units to achieve substantially the same purpose. Additionally, it is described herein that the pin extending from the door may extend from either the door extension or the end surface of the door. For the purposes of this application, the end surface of the door will be treated as comprising both the end surface of the face portion of the door and the door extension.

Figure 1:
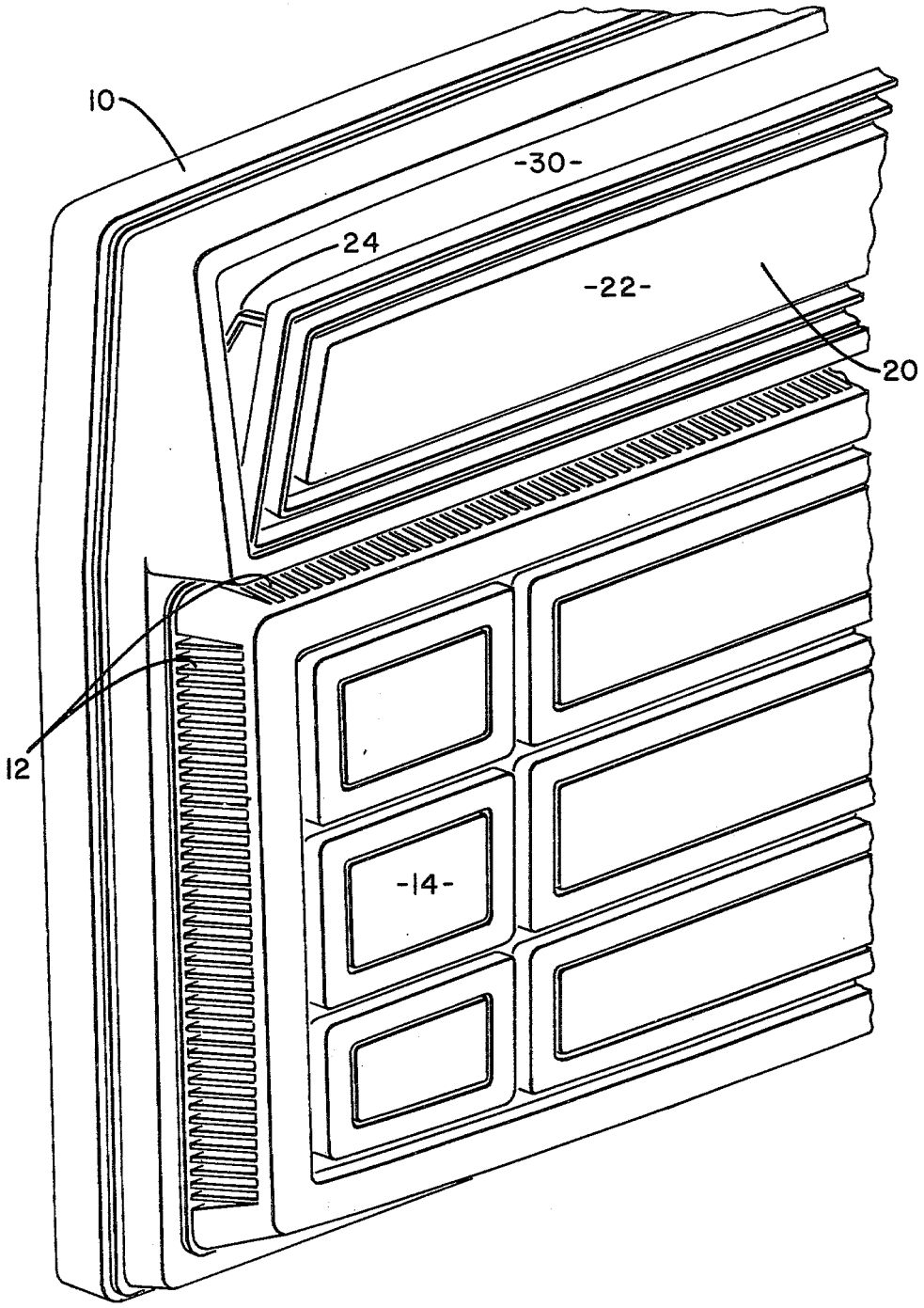
FIG. 1 is a perspective view of a portion of the casing and door of a room air conditioning unit.

Referring now to FIG. 1, there may be seen a perspective view of the grille portion of a room air conditioning unit. The front cover 10 of the unit is designed to cover the end of the unit such that the evaporator and remaining mechanical equipment are hidden from view. Return air openings 12 are shown in the front cover, said openings serving to allow air from the enclosure to be conditioned to enter the unit. Door opening 30 is that space wherein the conditioned air is discharged into the enclosure to be conditioned. Discharge door 20 is shown mounted to cover door opening 30. Discharge door 20 has face portion 22 and door extension 24. Control door 14 is further indicated in FIG. 1. The various controls to operate the unit may be located behind the control door and hidden from view for esthetic purposes.

Figure 2:
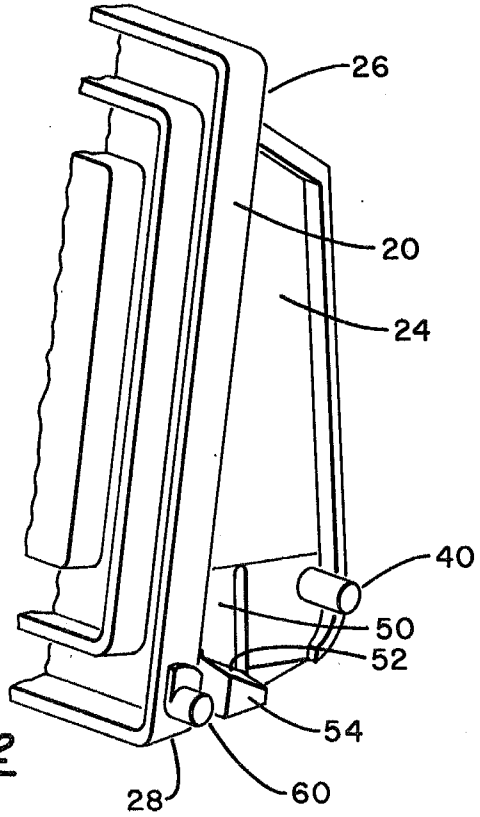
FIG. 2 is a perspective view showing the end configuration of the discharge door.

In FIG. 2 the end configuration of the door may be seen. The door has face portion 20 utilized to cover the door opening and door extension 24. At the top of the door a contact surface 26 is shown for engaging the appropriate portion of the casing. Extending outwardly from the end surface of the door are front pin 60, back pin 40 and friction wedge 50. It can be further seen that friction wedge 50 has formed as a part thereof friction surface 54 and inclined surface 52. Upon rotation of the door the friction wedge must be displaced inwardly as it is rotated. The force created by this displacement acts to provide sufficient force to secure the door in position with the friction surface. Additionally, the bottom of the face portion of the door forms the bottom door contact surface 28.

Figure 3:
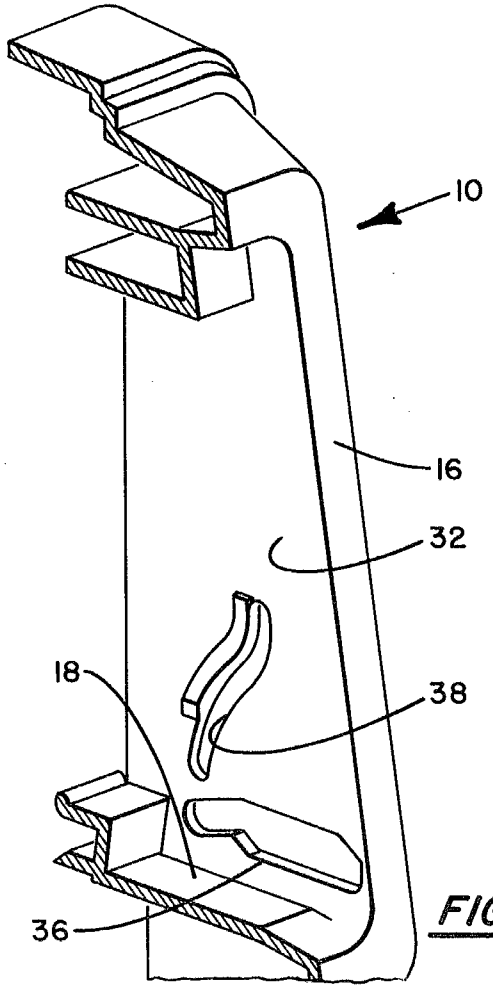
FIG. 3 is a perspective view of the side surface of the door opening in the casing.

In FIG. 3, there can be seen door opening side surface 32 having bottom slot 36 and top slot 38 formed therein. Door opening side surface 32 is a portion of front cover 10. Additionally, there can be seen top sealing surface 16 which is adapted to coact with the top door contact surface 26 to provide a seal at the top of the door. Bottom sealing surface 18 extending inwardly from the front of the unit is adapted to provide a seal at the bottom of the door when coacting with bottom door contact surface 28.

Figure 4:
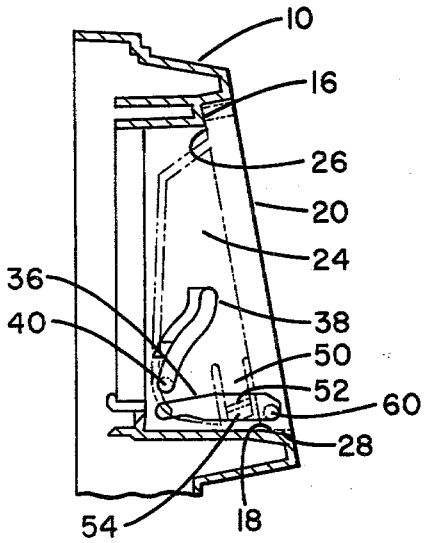
FIG. 4 is a sectional view showing the door mounted within the casing in a closed position.

Operation of the door of the unit is depicted in FIGS. 4 through 7. In the fully closed position as can be seen in FIG. 4, pins 40 and 60 are located within slots 38 and 36 respectively and friction wedge 54 is located such that it extends into slot 36 and does not engage a portion of the slot nor a portion of the door opening side surface. Top door contact surface 26 engages top sealing surface 16 and bottom door contact surface 28 engages bottom sealing surface 18 such that top and bottom seals are provided. In this position the door is fully closed and there is no air flow discharged from the unit.

Figure 5:
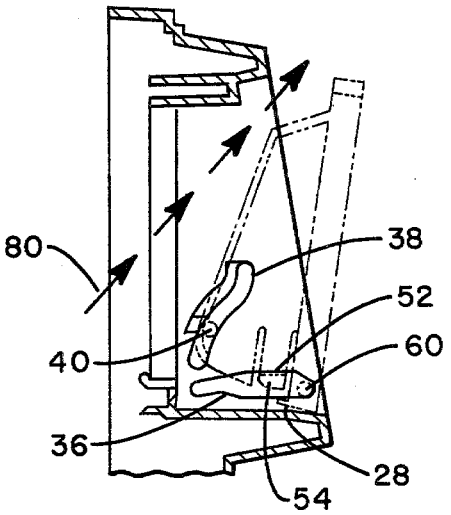
FIG. 5 is a sectional view of the door in the casing, the door being in the partially open position to which the door may be forced by the flow of air through the unit.

Once the unit is energized the evaporator fan causes air to be discharged from the unit. In FIG. 5, a set of arrows designated by numeral 80 is used to indicate the path of this air flow. The force exerted by the air on the door causes it to open to the position shown in FIG. 5. Again, pin 40 is located within slot 38 and pin 60 is within slot 36. A comparison of FIGS. 4 and 5 indicates that pin 60 has not moved as the door rotates to this position, however, pin 40 has moved upwardly. Additionally, as can be seen in FIG. 5, the friction wedge extending into slot 36 is rotated upwardly until inclined surface 52 engages the edge of slot 36. The force of the air against the door causes the door to open until the inclined surface engages the slot. Consequently the door is maintained in that position until the door is manually opened further or closed. The top door contact surface is separated from the top sealing surface such that air flow may pass through. The bottom door sealing surface 28, remains in engagement with the bottom sealing surface 18.

Figure 6:
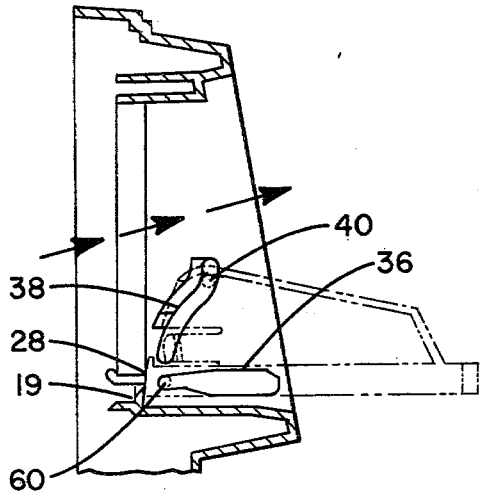
FIG. 6 is a sectional view showing the door and the casing with the door being in the fully open position.

In FIG. 6 the door is shown in the fully open position and it may be seen that pin 60 has traveled the length of slot 36 as has pin 40 in regard to slot 38. The bottom sealing surface 28 of the door remains in engagement with the bottom sealing surface 18 of cover 10 and in this position may additionally engage abutment 19. Friction wedge 50 has been displaced inwardly as the door is rotated beyond the position shown in FIG. 5 such that friction surface 54 engages a portion of side surface 32 securing the door in the fully open position. It can be further seen in FIG. 6 that by providing the combination pin and slot lost motion rotation that the axis of rotation of the door has moved as the door is rotated. Additionally it can be seen that the bottom of the door has moved inwardly such that the overall distance the door extends from the unit has been decreased eliminating the potential for accidental contact with the door.

Figure 7:
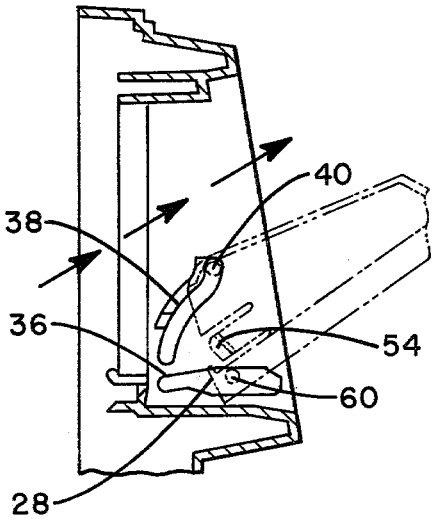
FIG. 7 is a sectional view showing the door and the casing with the door being partially open to a position where the frictional surface secures the door in said position.

Referring now to FIG. 7, the door can be seen in a partially open position between that shown as full open in FIG. 6 and that caused by air flow shown in FIG. 5. As seen in FIG. 7, the door has friction wedge 50 extending therefrom with friction surface 54 engaging the side surface of the cover securing the door in that position. Pin 60 is shown in the middle of slot 36 and pin 40 is at the top of slot 38. The bottom sealing surface 28 of the door remains in engagement with the sealing surface 18 of the cover.

From the drawings and herein description it is seen that the combination of pins and slots provides for lost motion rotation of the door such that as the door is rotated the bottom travels inwardly and the bottom sealing surface of the door is maintained in sealing engagement with the sealing surface 18 of the cover. The friction wedge extending from the door toward the end surface acts to allow partial rotation of the door as a result of pressure created by air flow. Upon additional rotation of the door the frictional wedge will be displaced inwardly creating a frictional force against the end surface of the door to further provide apparatus for securing the door in a range of positions between fully open (FIG. 6) and partially open as a result of discharge air flow (FIG. 5).

The herein invention has been described in reference to a particular embodiment. It is to be understood that modifications and variations can be made within the spirit and the scope of the invention.

I claim:

1. An air conditioning unit having a flow path through which conditioned air is discharged to a space which comprises:

a casing defining a discharge opening through which the conditioned air may flow, said opening having side surfaces which each define a pair of slots;

a door to cover the discharge opening, said door having a pair of pins extending from each end surface of the door, said pins being adapted to engage the slots defined by the side surface of the casing whereby the door may be rotated to various open positions; and a friction wedge mounted to extend from the door to engage the side surface of the casing for securing the door in a position, said friction wedge including an inclined surface extending from the door to engage an edge of a slot in the casing such that the door may be partially opened to the position at which the inclined surface engages the slot edge by the force exerted against the door by the conditioned air conducted along the flow path through the opening.

2. The apparatus as set forth in claim 1 wherein the door including the pins and the friction wedge are all formed as a single integral member.

3. The apparatus as set forth in claim 1 wherein the first slot is generally horizontal and the second slot is curvilinear and located above the first slot such that upon rotation of the door the bottom of the door moves inwardly and the distance the door extends outwardly from the casing is limited.

4. The apparatus as set forth in claim 3 wherein the bottom of the door forms a bottom door contact surface, wherein the casing defines a bottom sealing surface and wherein the pins extending from the door coact with the casing to maintain the bottom door contact surface in sealing engagement with the bottom sealing surface of the casing as the door is rotated.

5. A discharge door assembly for use with an air conditioning unit which comprises:

a casing defining a discharge opening, said casing having a top sealing surface, a bottom sealing surface and two side surfaces, each side surface having a generally horizontal slot and a curvilinear slot spaced above the horizontal slot; and a door having a. a face portion for covering the discharge opening defined by the casing, said face portion including a top door contact surface coacting with the top sealing surface of the casing and a bottom door contact surface coacting with the bottom sealing surface of the casing, b. a door extension one each end of the door including the end surface of the face portion and the portion extending inwardly therefrom, each door extension having a front pin which is adapted to slide within the horizontal slot in the side surface of the casing and a back pin which is adapted to slide within the curvilinear slot in the side surface of the casing, the slots being appropriately configured such that the door may be rotated between the open and closed positions upon a changing axis of rotation while maintaining the bottom contact surface adjacent to the bottom of the sealing surface, and c. a friction wedge having a friction surface extending from the door extension into frictional engagement with the side surface of the casing, said surface acting to secure the door in a position and an inclined surface which upon a preselected amount of rotation engages an edge of the horizontal slot to affix the door in that position.

6. The apparatus as set forth in claim 5 wherein the face portion, the end surface, the door extension, the pins and the friction wedge are all formed as a single integral member.

7. The apparatus as set forth in claim 8 wherein when the door is in the closed position the friction wedge is located within the horizontal slot in the casing, said door being capable of being rotated with a minimal force until the inclined surface of the friction wedge engages an edge of the horizontal slot.

* * * * *